US011137133B2

(12) United States Patent
Huang et al.

(10) Patent No.: US 11,137,133 B2
(45) Date of Patent: Oct. 5, 2021

(54) LIGHTING APPARATUS

(71) Applicant: XIAMEN ECO LIGHTING CO. LTD., Xiamen (CN)

(72) Inventors: Zhenkun Huang, Xiamen (CN); Shouqiang Hou, Xiamen (CN); Caibin Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/816,200

(22) Filed: Mar. 11, 2020

(65) Prior Publication Data

US 2020/0340659 A1 Oct. 29, 2020

(30) Foreign Application Priority Data

Apr. 28, 2019 (CN) ..... 201920599570.5
Apr. 28, 2019 (CN) ..... 201920599591.7

(51) Int. Cl.

| | |
|---|---|
| ***F21V 25/02*** | (2006.01) |
| ***F21V 21/02*** | (2006.01) |
| ***F21V 25/12*** | (2006.01) |
| ***G08B 17/06*** | (2006.01) |
| *F21Y 115/10* | (2016.01) |

(52) U.S. Cl.

CPC ..... *F21V 25/02* (2013.01); *F21V 21/02* (2013.01); *F21V 25/12* (2013.01); *G08B 17/06* (2013.01); *F21Y 2115/10* (2016.08)

(58) Field of Classification Search

CPC ..... F21V 25/02; F21V 21/02; F21V 25/12; G08B 17/06; F21Y 2115/10

USPC ..... 340/584

See application file for complete search history.

(56) References Cited

U.S. PATENT DOCUMENTS

| | | | | | |
|---|---|---|---|---|---|
| 2,869,097 | A * | 1/1959 | Simon | H01R 33/22 | 439/256 |
| 4,255,746 | A * | 3/1981 | Johnson | F21V 33/0076 | 340/577 |
| 4,694,223 | A * | 9/1987 | Campolo | F21V 25/10 | 315/117 |
| 8,033,686 | B2 * | 10/2011 | Recker | H05B 45/00 | 362/249.02 |
| 10,823,375 | B2 * | 11/2020 | Zhang | F21S 8/063 | |
| 2012/0120658 | A1 * | 5/2012 | Wilk | F21V 29/763 | 362/249.02 |
| 2013/0308310 | A1 * | 11/2013 | Wilk | F21S 41/143 | 362/235 |
| 2020/0354513 | A1 * | 11/2020 | Niemiec | F04D 29/545 | |

FOREIGN PATENT DOCUMENTS

| | | | | |
|---|---|---|---|---|
| WO | WO-03002909 A1 * | 1/2003 | F21S 8/086 | |

* cited by examiner

*Primary Examiner* — John A Tweel, Jr.
(74) *Attorney, Agent, or Firm* — Chun-Ming Shih; Lanway IPR Services

(57) ABSTRACT

In an embodiment, a lighting apparatus includes a cup housing, a light source module, a protective cover and a light passing cover. The cup housing includes a platform and a first surrounding wall. The light source module has multiple LED modules mounted on the platform surrounded by the first surrounding wall. The platform may be a flat plate or a curve surface. Holes, protrusion or other structures may also appear on the platform. In some embodiments, the platform provides positioning structures for aligning and installing the light source module.

19 Claims, 9 Drawing Sheets

LIGHTING APPARATUS

FIELD

The present invention is related to a lighting apparatus and more particularly related to a lighting apparatus with a protection design.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In an embodiment, a lighting apparatus includes a cup housing, a light source module, a protective cover and a light passing cover.

The cup housing includes a platform and a first surrounding wall. The light source module has multiple LED modules mounted on the platform surrounded by the first surrounding wall. The platform may be a flat plate or a curve surface. Holes, protrusion or other structures may also appear on the platform. In some embodiments, the platform provides positioning structures for aligning and installing the light source module.

The protective cover has a second surrounding wall and a top cover. The second surrounding wall and the top cover form an inner container for covering and protecting the plurality of LED modules of the light source module.

The light passing cover is supported by the first surrounding wall. A light of the plurality of LED modules being passed through the light passing cover.

In some embodiments, the top cover of the protective cover has a top opening facing to the plurality of LED modules. For example, the top has a central part open facing to the LED modules mentioned above so that the light of the LED modules passes through the top opening to the light passing cover.

In some embodiments, the top cover has other portion preventing light to pass through, thus providing a limiting effect for restricting light to pass through certain directions. The interior surface of the top cover and the first surrounding wall, if not light passing, may be disposed with a reflection layer for reflecting light.

In addition, both the first surrounding wall and the second surrounding wall may be made of heat dissipation material like metal material for guiding heat out of the light source.

Meanwhile, the first surrounding wall and the second surrounding wall protect the light source module and related circuit from external damaging force, e.g. water, smog, dust. On the other hand, the proactive cover provides an additional protection to users if the light source and related module inside the protective cover has safety problem, e.g. short circuit or other problem.

In addition, the protective cover also prevents an amount of electro-magnetic wave causing potential risk to human health.

In some embodiments, the top opening is attached with an optical lens for changing moving directions the light of the plurality of LED modules. For example, the optical lens may be a condensing lens for forming a light beam with a small light beam angle. In some other embodiments, the optical lens may be used for diffusing light, or generate a different light pattern, e.g. a central light beam surrounded with peripheral diffusing light.

In some embodiments, the second surrounding wall allows the light of the plurality of LED modules to pass to through. A lateral optical characteristic of the second surrounding wall is different from a top optical characteristic of the top cover.

In some embodiments, the light source module includes a circuit board mounted with the plurality of LED modules.

The second surrounding wall is fixed to the circuit board and forms a module unit together with the light source module.

In some embodiments, there is a metal rim connected to a peripheral edge of the first surrounding wall for enhancing heat dissipation.

In some embodiments, there is an air guiding structure between the first surrounding wall and the metal rim for creating a heat difference environment guiding air to flow for further enhancing heat dissipation.

In some embodiments, the light passing cover has a bent portion having a protruding portion. A connecting edge of the first surrounding wall has a first buckle groove and a second buckle groove. When the light passing cover is installed to the first surrounding wall, the bent portion is inserted into the first buckle groove, bent and then hooked in the second buckle groove for fixing the light passing cover to the first surrounding wall.

In some embodiments, there is a temperature sensor structure, turning off a circuit of the light source module.

In some embodiments, the protective cover is made of fireproof material for preventing an accident fire from outside to enter the protective cover.

In some embodiments, the protective cover is made of fireproof material for preventing a circuit covered by the protective cover to get fire.

In some embodiments, there is deformational structure deformed when a temperature is over a threshold, the deformational structure triggers an alarm procedure.

In some embodiments, the lighting apparatus also has a smoking detector electrically connected to an alarm processor of the light source module.

In some embodiments, when a fire alarm situation is detected, a transmitter sends an alarm message to a neighbor lighting apparatus. The neighbor lighting apparatus relays the alarm message to another processor. In other words, even if the lighting function is out of order three minutes later due to a fire accident, the alarm message may be routed to a person or a device for taking proper action. The transmitter may be a local transmitter with no capability to connect to the Internet or a telecommunication network. However, when the alarm message is relayed to another device, which may be continued for one or multiple times until a device equipped with a SIM card or a connectivity to an external world, the alarm message may be handled properly while the lighting apparatus needs not to be installed with complicated electronic devices just for ensuring safety in a rare situation.

In some embodiments, when a receiver of the light source module receives the alarm message from a neighbor lighting apparatus, the light source module relays the alarm message to another processor.

In some embodiments, the light passing cover has a connector for attaching a detachable optical unit.

In some embodiments, the light passing cover is not removable by a normal hand, but the detachable optical unit is detachable by a normal hand for replacing with another optical unit. Due to certain safety standard requirements, when a device is supplied with electricity, it needs to be difficult to be broken or destructed with normal hands, e.g. without a tool or a violence activity. Some structures help one-way installation. In other words, with such structure, like a reverse hook or the bent structure mentioned above, the light passing cover may be easily installed but difficult to be removed from the lighting apparatus.

In some embodiments, the lighting apparatus also includes a central column extended from the platform to the light passing cover. The central column may be used for connecting the light passing cover, used for enhancing overall rigidity or even be used as an additional light source by embedding light component on the central column.

In some embodiments, a bottom end of the central column has a coil unit for charging an attached device attached on an exterior side of the light passing cover.

In some embodiments, a second light source is attached on a surface of the attached device. In other words, the attached device does not form a dark area of the lighting apparatus.

DETAILED DESCRIPTION

Figure 9:
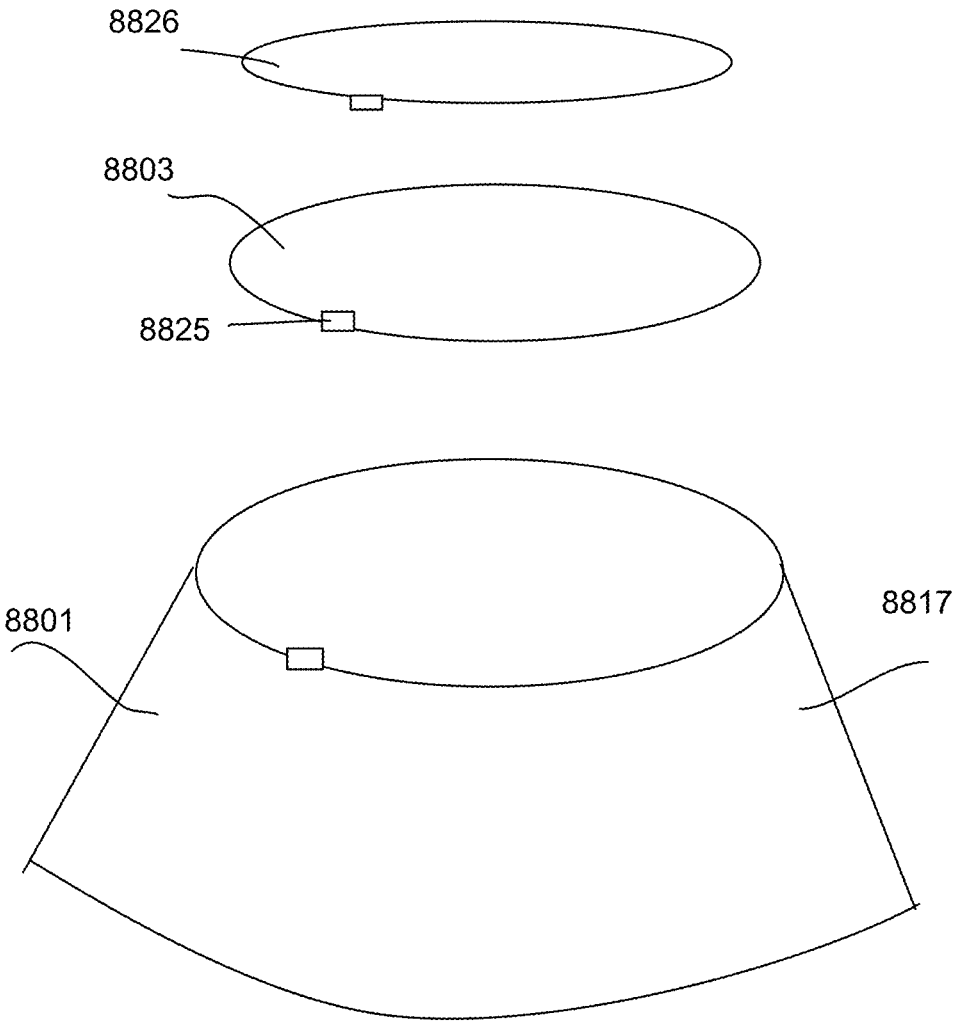
FIG. 9 is side schematic view of a lighting apparatus of an embodiment.
Figure 10:
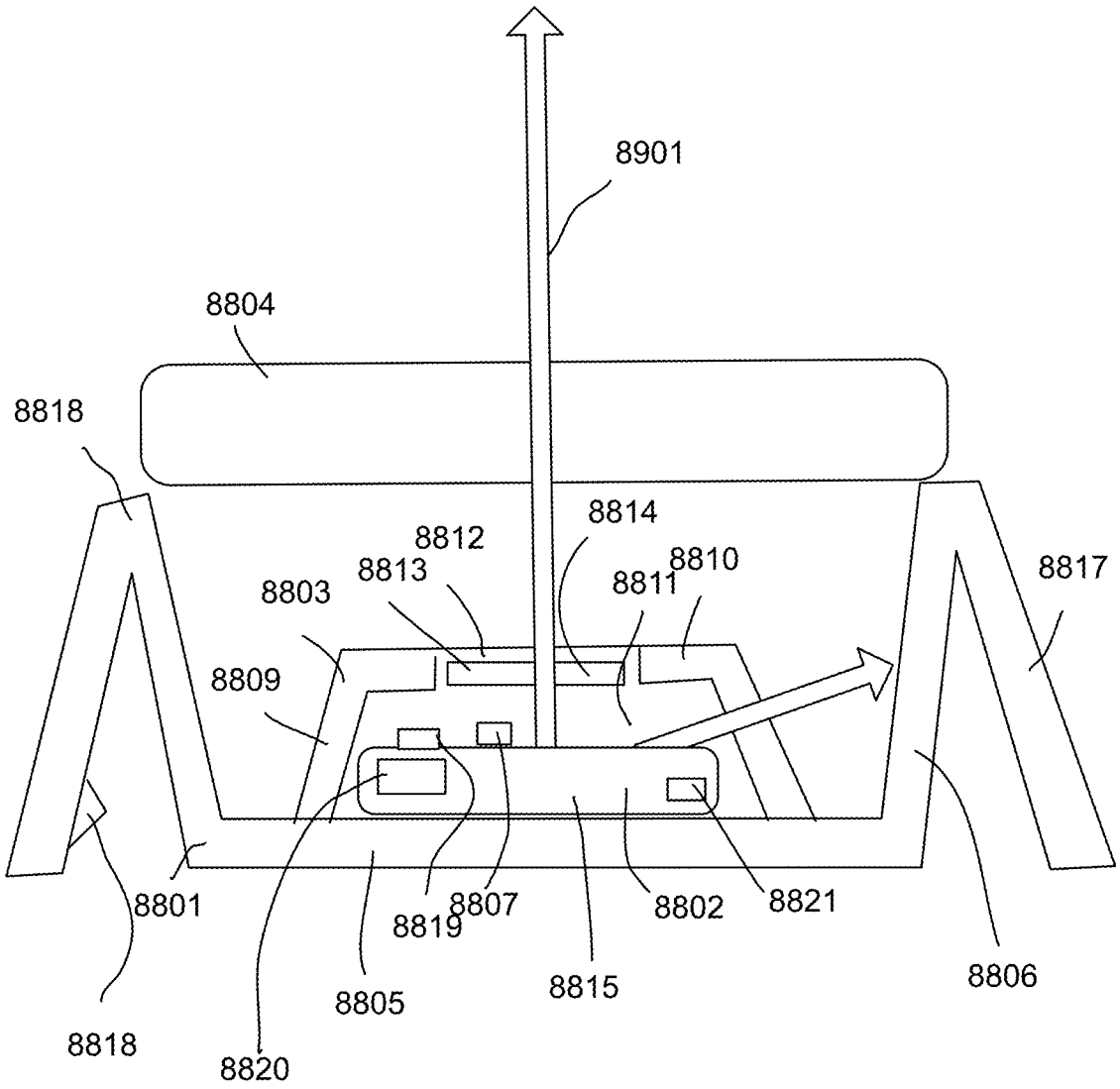
FIG. 10 is a perspective view of a lighting apparatus of an embodiment.

Please refer to FIG. 9 and FIG. 10, a lighting apparatus includes a cup housing 8801, a light source module 8802, a protective cover 8803 and a light passing cover 8804.

The cup housing 8801 includes a platform 8805 and a first surrounding wall 8806. The light source module 8802 has multiple LED modules 8807 mounted on the platform 8805 surrounded by the first surrounding wall 8806. The platform 8805 may be a flat plate or a curve surface. Holes, protrusion or other structures may also appear on the platform 8805. In some embodiments, the platform 8805 provides positioning structures for aligning and installing the light source module 8802.

The protective cover 8803 has a second surrounding wall 8809 and a top cover 8810. The second surrounding wall 8809 and the top cover 8810 form an inner container 8811 for covering and protecting the plurality of LED modules 8807 of the light source module 8802.

The light passing cover 8804 is supported by the first surrounding wall 8806. A light 8901 of the plurality of LED modules 8807 is passed through the light passing cover 8804.

In some embodiments, the top cover 8810 of the protective cover 8803 has a top opening 8812 facing to the plurality of LED modules 8807. For example, the top cover 8810 has a central part 8813 open facing to the LED modules 8807 mentioned above so that the light of the LED modules 8807 passes through the top opening 8812 to the light passing cover 8804.

In some embodiments, the top cover 8810 has another portion preventing light to pass through, thus providing a limiting effect for restricting light to pass through certain directions. The interior surface of the top cover and the first surrounding wall, if not light passing, may be disposed with a reflection layer for reflecting light.

In addition, both the first surrounding wall and the second surrounding wall may be made of heat dissipation material like metal material for guiding heat out of the light source.

Meanwhile, the first surrounding wall and the second surrounding wall protect the light source module and related circuit from external damaging force, e.g. water, smog, dust. On the other hand, the proactive cover provides an additional protection to users if the light source and related module inside the protective has safety problem, e.g. short circuit or other problem.

In addition, the protective cover also prevents an amount of electro-magnetic wave causing potential risk to human health.

In some embodiments, the top opening is attached with an optical lens 8814 for changing moving directions the light of the plurality of LED modules. For example, the optical lens may be a condensing lens for forming a light beam with a small light beam angle. In some other embodiments, the optical lens may be used for diffusing light, or generate a different light pattern, e.g. a central light beam surrounded with peripheral diffusing light.

In some embodiments, the second surrounding wall allows the light of the plurality of LED modules to pass to through. A lateral optical characteristic of the second surrounding wall is different from a top optical characteristic of the top cover. For example, the second surrounding wall may be used for diffusing light while the top cover is used for condensing light to a light beam.

In some embodiments, the light source module includes a circuit board 8815 mounted with the plurality of LED modules. The second surrounding wall is fixed to the circuit board 8815 and forms a module unit together with the light source module.

In some embodiments, there is a metal rim 8817 connected to a peripheral edge 8818 of the first surrounding wall 8806 for enhancing heat dissipation.

In some embodiments, there is an air guiding structure 8818 between the first surrounding wall 8806 and the metal rim 8817 for creating a heat difference environment guiding air to flow for further enhancing heat dissipation.

For example, different areas of the cup housing are detected or simulated for heat conductive distribution. In addition to conduct heat from the light source module to outside to keep the light source module with longer life span, air is also a good medium for carrying away unwanted heat. There is a space between the surface rim and the first surrounding wall and thus the facing surfaces of the surface rim and the first surrounding wall may be disposed with guiding structures like groove, protruding bars for creating a heat difference between two parts of the space, and further adds some guiding structure for enhancing air for moving in the space or even guided to move outside the lighting apparatus.

The guiding structure may include multiple paths with a micro cyclone, a micro tornado, or other forms of air flow in the space. Different space structure and size may need different air guiding structures to optimize heat dissipation. The present invention is great to be integrated with such structures for further enhancing the lighting apparatus.

In some embodiments, the light passing cover has a bent portion having a protruding portion. A connecting edge of the first surrounding wall has a first buckle groove and a second buckle groove. When the light passing cover is installed to the first surrounding wall, the bent portion is inserted into the first buckle groove, bent and then hooked in the second buckle groove for fixing the light passing cover to the first surrounding wall.

In some embodiments, there is a temperature sensor structure 8819, turning off a circuit of the light source module.

In some embodiments, the protective cover is made of fireproof material for preventing an accident fire from outside to enter the protective cover.

In some embodiments, the protective cover is made of fireproof material for preventing a circuit covered by the protective cover to get fire.

In some embodiments, there is deformational structure 8820 deformed when a temperature is over a threshold, the deformational structure triggers an alarm procedure.

In some embodiments, the lighting apparatus also has a smoking detector 8821 electrically connected to an alarm processor of the light source module.

Figure 11:
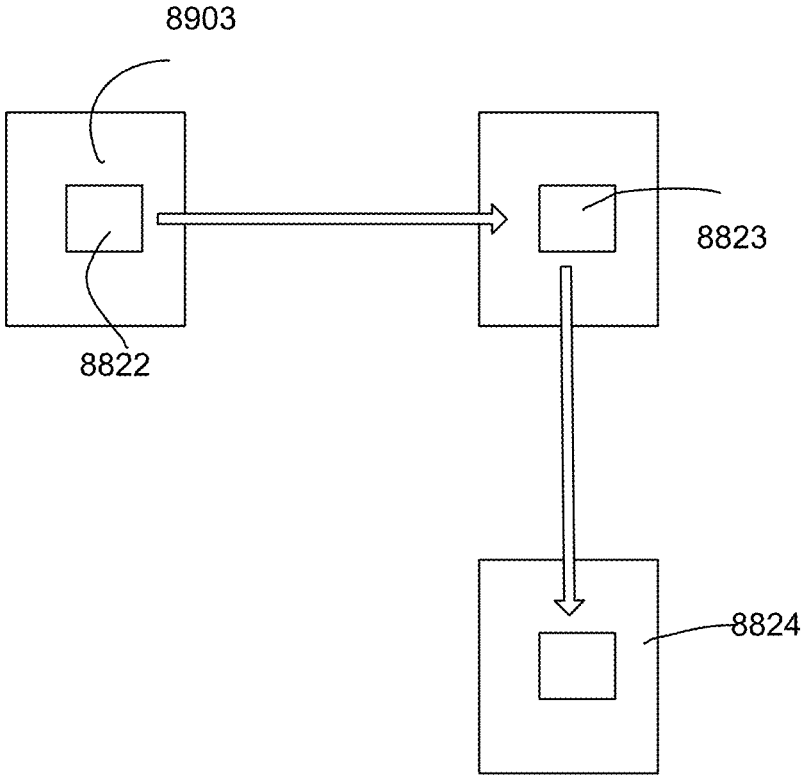
FIG. 11 is a schematic view of a lighting apparatus of an embodiment.

Please refer to FIG. 11, when a fire alarm situation is detected, a transmitter 8822 of a lighting apparatus 8903 sends an alarm message to a neighbor lighting apparatus 8823. The neighbor lighting apparatus 8823 relays the alarm message to another processor 8824. In other words, even if the lighting function is out of order three minutes later due to a fire accident, the alarm message may be routed to a person or a device for taking proper action. The transmitter may be a local transmitter with no capability to connect to the Internet or a telecommunication network. However, when the alarm message is relayed to another device, which may be continued for one or multiple times until a device equipped with a SIM card or a connectivity to an external world, the alarm message may be handled properly while the lighting apparatus needs not to be installed with complicated electronic devices just for ensuring safety in a rare situation.

In some embodiments, when a receiver of the light source module receives the alarm message from a neighbor lighting apparatus, the light source module relays the alarm message to another processor.

Please refer to FIG. 9, the light passing cover has a connector 8825 for attaching a detachable optical unit 8826.

In some embodiments, the light passing cover is not removable by hand, but the detachable optical unit is detachable by a normal hand for replacing with another optical unit. Due to certain safety standard requirements, when a device is supplied with electricity, it needs to be difficult to be broken or destructed with normal hands, e.g. without a tool or a violence activity. Some structures help on one-way installation. In other words, with such structure, like a reverse hook or the bent structure mentioned above, the light passing cover may be easily installed but difficult to be removed from the lighting apparatus.

Figure 12:
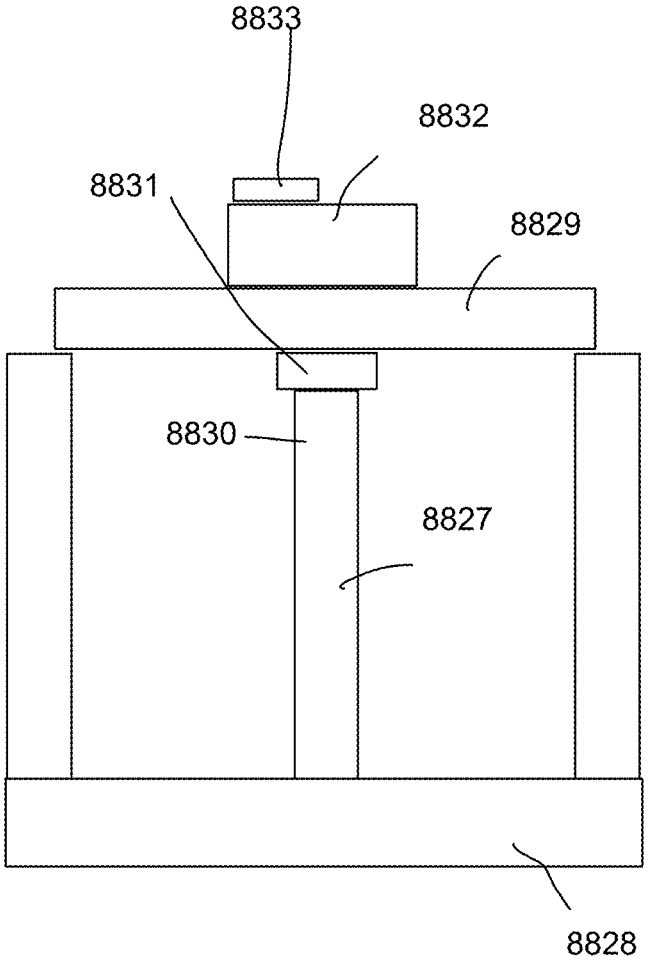
FIG. 12 is a schematic view of a lighting apparatus of an embodiment.

In FIG. 12, the lighting apparatus also includes a central column 8827 extended from the platform 8828 to the light passing cover 8829. The central column 8827 may be used for connecting the light passing cover 8829, used for enhancing overall rigidity or even be used as an additional light source by embedding light component on the central column 8827.

In some embodiments, a bottom end 8830 of the central column 8827 has a coil unit 8831 for charging an attached device 8832 attached on an exterior side of the light passing cover 8829.

In some embodiments, a second light source 8833 is attached on a surface of the attached device 8832. In other words, the attached device 8832 does not form a dark area of the lighting apparatus with such design.

Please refer to FIG. 1, FIG. 2, FIG. 3 and FIG. 4, a LED UFO lighting apparatus 1 is provided. The LED UFO lighting apparatus 1 has a base housing 11 having a light emitting opening, a light source module 12 and a light passing cover 13. The light passing cover has a buckle 14, and the base housing has a buckle slot 15.

The light source module 12 is in the base housing 11, the light passing cover 13 covers on the light emitting opening of the base housing 11. The buckle 14 is on one end of the light passing cover 13 to the base housing 11, and the buckle slot 15 is set on the base housing 11 correspondingly to the buckle 14. The buckle 14 has a connecting piece 141 connecting with the light passing cover 13 and a bent portion 142 bent from one end of the connecting piece 141 to the buckle slot 15. The bent portion 142 has a body portion 1421 connecting with the connecting piece 141 and a protruding portion 1422 extending from one end of the body portion 1421 to the light passing cover 13. The buckle slot 15 has a first buckle groove 151 and a second buckle groove 152 set mutually isolated. The bent portion 142 is capable of sliding through the first buckle groove 151 to buckle the protruding portion 1422 and the second buckle groove 152 to prevent the light passing cover 13 from rotating along the first buckle groove 151 and falling during the transportation or in vibration.

The concrete method, firstly, set the light source module 12 in the base housing 11, and then set along the light passing cover 13 and the base housing 11. When setting the light passing cover 13 and the base housing 11, insert the buckle 14 into the first buckle groove 151 and rotate the light passing cover 13 to let the buckle 14 to slide along the direction of the first buckle groove 151 until the protruding portion 1422 of the bent portion 142 buckles with the second buckle groove 142, thus the installation of the light passing cover 13 and the base housing 11 is finished. Because the protruding portion 1422 of the bent portion 142 buckles with the first buckle groove 151, and the first buckle groove 151 is isolated from the second buckle groove 152, thus even if the UFO lighting apparatus is in vibration, the buckle 14 is not capable of rotating along the first buckle groove 151 to let the light passing cover 13 to fall.

Apparently, in the LED UFO lighting apparatus 1 provided, the buckle slot 15 is set as the first buckle groove 151 and the second buckle groove 152 set mutually isolated, the bent portion 142 is capable of sliding through the first buckle groove 151 to the second buckle groove 152 to let the protruding portion 1422 of the bent portion 142 to buckle with the second buckle groove 152. Because the first buckle groove 151 is isolated from the second buckle groove 152, and a part of the bent portion 142 buckles in the second buckle groove 152 to let the bent portion 142 is not capable of rotating along the first buckle groove 151 and to let the light passing cover 13 is not capable of detaching from the base housing 11, this buckling method thus solves the problem of the light passing cover 13 of falling easily.

Figure 3:
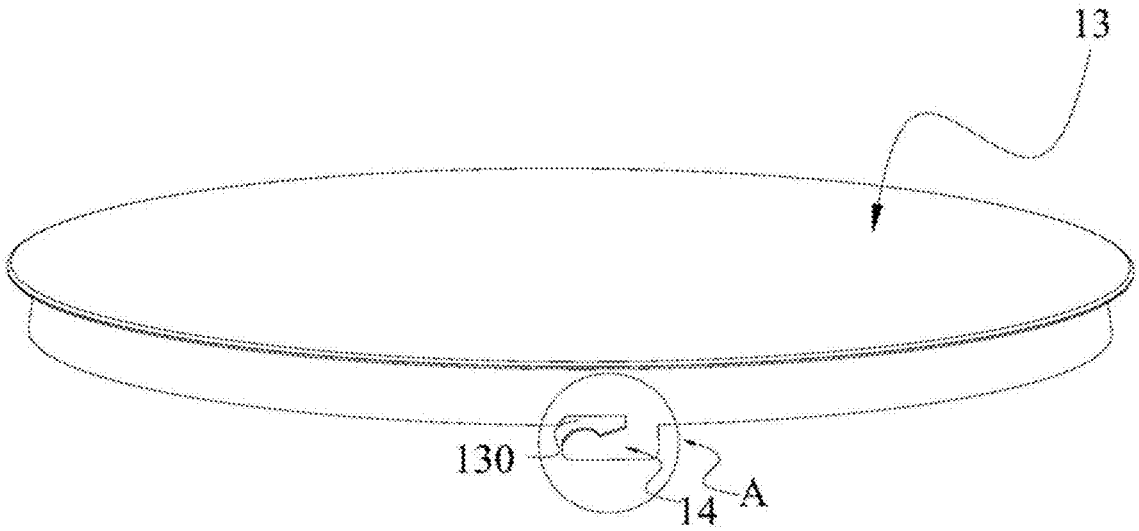
FIG. 3 shows a lighting passing cover example.
Figure 4:
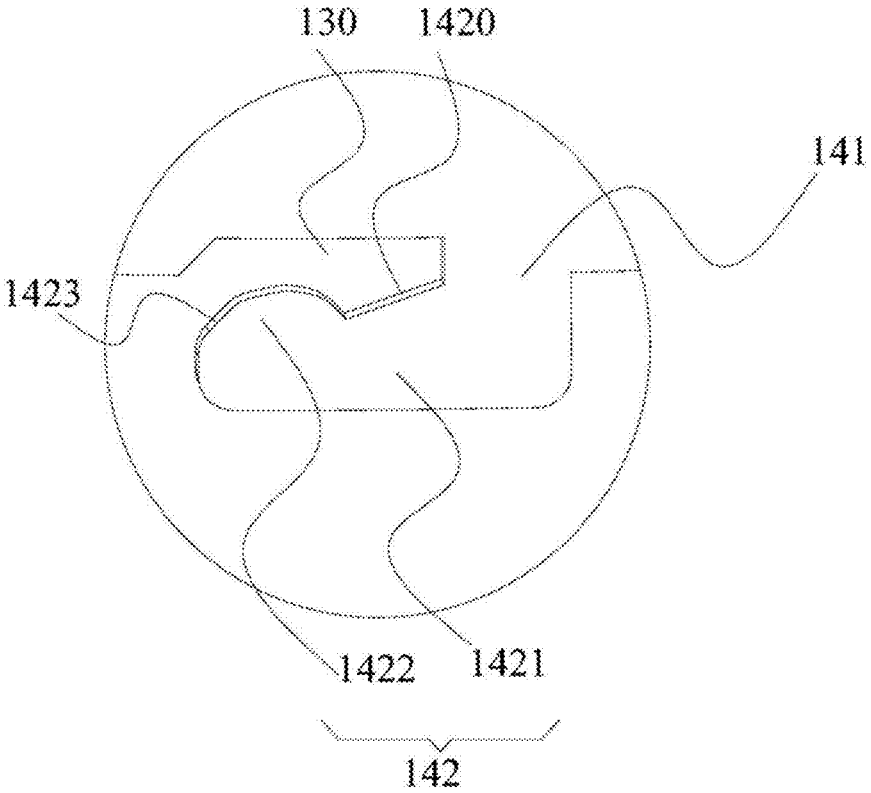
FIG. 4 shows an enlarged view of a portion of the example in FIG. 3.
Figure 5:
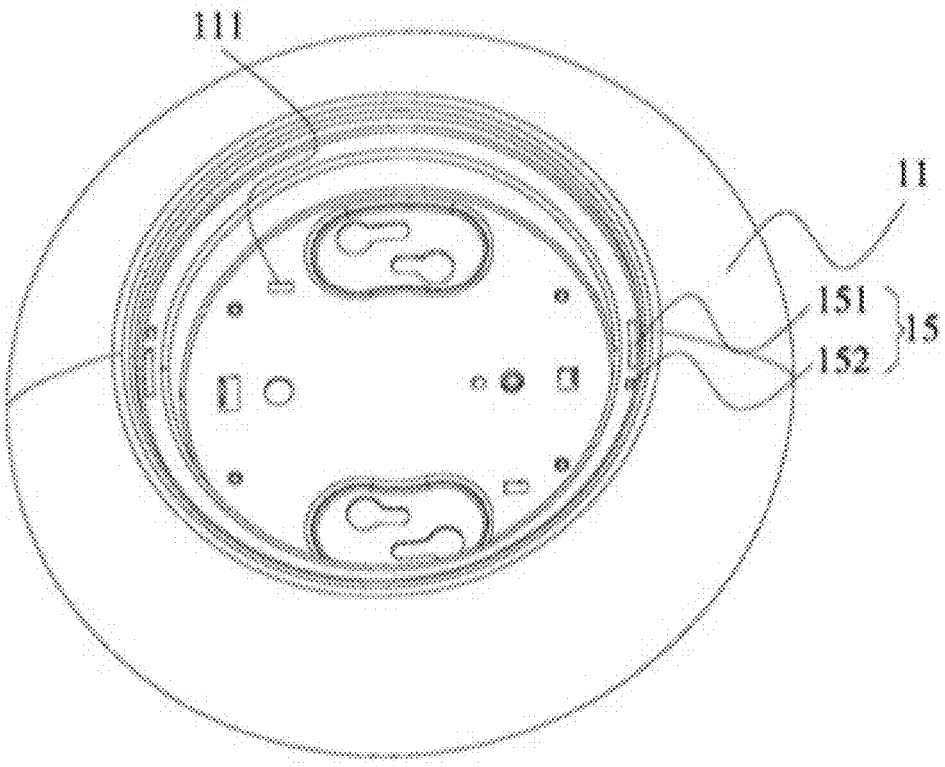
FIG. 5 shows an example of a cup housing.

Please refer to FIG. 3 to FIG. 5. The first buckle groove 151 is a curve groove, and the bent portion 142 is a curve piece. A curve ratio of the first buckle groove 151 is consistent with the curve ratio of the bent portion 142. The length and quantity of the first buckle groove 151 is capable of being set according to actual needs.

For further explanation, in order to let the bent portion 142 being inserted into the first buckle groove 151 easily, sliding along the first buckle groove 151, a centering angle of the first buckle groove 151 has to be greater than or equal to the centering angle of the bent portion 142.

To firmly connect, the quantity of the buckle slot 15 is two. A curve center of two buckle slot 15 overlap. Two second buckle groove 152 in two buckle slot 15 are respectively set on the corresponding end of the first buckle groove 151; namely, one of the second buckle groove 152 is on one end of the corresponding first buckle groove 151 while the other second buckle groove 152 is on the other end of the corresponding first buckle groove 151. The ideal quantity of the bent portion 142 is two to set correspondingly with two buckle slot 15. The bent direction of the two bent portion 142 is opposite, so the two bent portion 142 is capable of buckling with the two second buckle groove 152. Namely, one of the two bent portion 142 located on different buckle slot 15 buckles with the second buckle groove 152 being on one end of the first buckle groove 151 while the other bent portion 142 buckles with the other second buckle groove 152 being on the other end of the first buckle groove 151.

In an embodiment, the bent portion 142 has the body portion 1421 and the protruding portion 1422. The body portion 1421 connects with the connecting piece 141, the protruding portion 1422 extends from one end of the body portion 1421 to the light passing cover 13. The protruding portion 1422 buckles with the second buckle groove 152 to let the light passing cover 13 and the base housing 11 to firmly connect.

More particularly, the second buckle groove 152 is a short groove buckling with the protruding portion 1422. The first buckle groove 151 is an elongated groove being capable of letting the bent portion 142 to slide through and thus letting the light passing cover 13 to rotate along the base housing 11.

Figure 6:
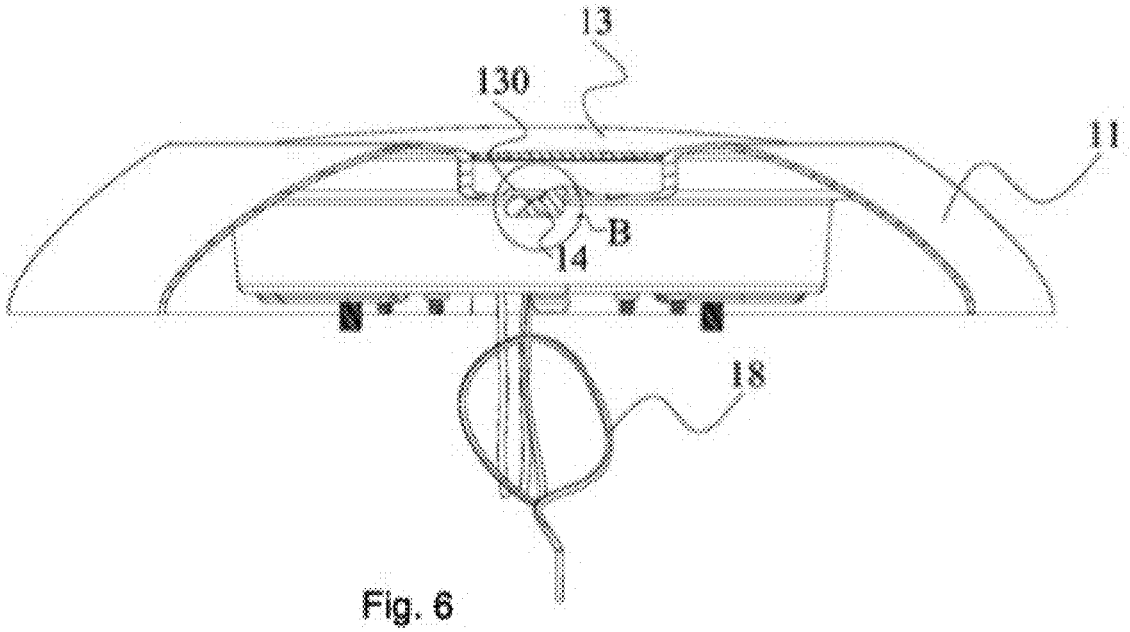
FIG. 6 is cross sectional view of the embodiment in FIG. 1.
Figure 7:
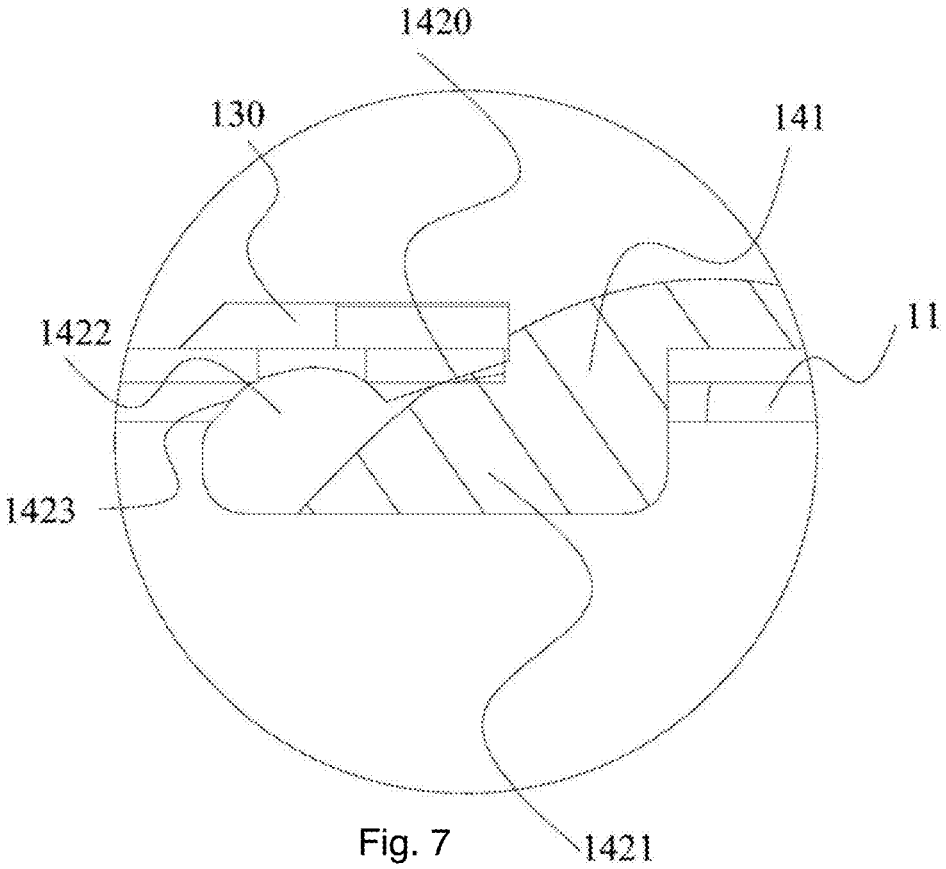
FIG. 7 shows a matched structure of an example.

Please refer to FIG. 6 and FIG. 7. A jointing side of the protruding portion 1422 to the buckle slot 15 has a guide surface 1423. The guide surface 1423 is capable of guiding the protruding portion 1422 to slide along the first buckle groove 151 to the second buckle groove 152 to buckle with the second buckle groove 152. More particularly, the guide surface 1423 is a tilt surface. The tilt direction deviates from the direction of the base housing 11.

In other embodiments, the guide surface is capable of being a curve or other shapes, as long as the guide surface is capable of guiding. In an embodiment, to increase the strength of the bent portion 142, the jointing side of the body portion 1421 to the protruding portion 1422 has a tilt surface 1420. Compared with a vertical surface, the tilt surface 1420 is capable of increasing the strength and the elastic deforming force of the bent portion 142.

In this embodiment, the tilt surface 1420 deviates from the protruding portion 1422, tilting up. The tilt surface 1420 is over matched with the portion of the base housing 11 being between the first buckle groove 151 and the second buckle groove 152.

With the tilt surface 1420, when the light passing cover 13 rotates deeper in the buckle slot 15 of the base housing 11, the tilt surface 1420 matches tighter with the portion of the base housing 11 being between the first buckle groove 151 and the second buckle groove 152. When the protruding portion 1422 buckles with the second buckle groove 152, a second guide surface is over matched with the portion of the base housing 11 being between the first buckle groove 151 and the second buckle groove 152 to prevent loosened installation of the light passing cover 13 and the base housing 11 being out of unstable allowable error during manufacturing.

In an embodiment, please refer to FIG. 6 and FIG. 7. A corresponding side of the light passing cover 13 to the bent portion 142 has an opening 130. The opening 130 lets the buckle 14 to hang on one side of the light passing cover 13 and lets one side of the light passing cover 13 is over matched with the base housing 11. Because the tilt surface 1420 and the portion of the base housing 11 being between the first buckle groove 151 and the second buckle groove 152 match tighter while a side wall of the opening 130 connecting with the second guide surface 1420 moves down, thus the side wall of the opening 130 connecting with the second guide surface 1420 contacts with the side wall of the first buckle groove 151. The opening 130 moves down while rotating deeper to let one side of the light passing cover 13 to match tighter with the base housing 11 and further over match to prevent loosened installation being out of allowable error during manufacturing.

Set tilted the opening 130 away from the side wall of the connecting piece 141 to let the protruding portion 1422 is capable of passing through the portion of the base housing 11 being between the first buckle groove 151 and the second buckle groove 152 when the protruding portion 1422 slides from the first buckle groove 151 to the second buckle groove 152.

Figure 1:
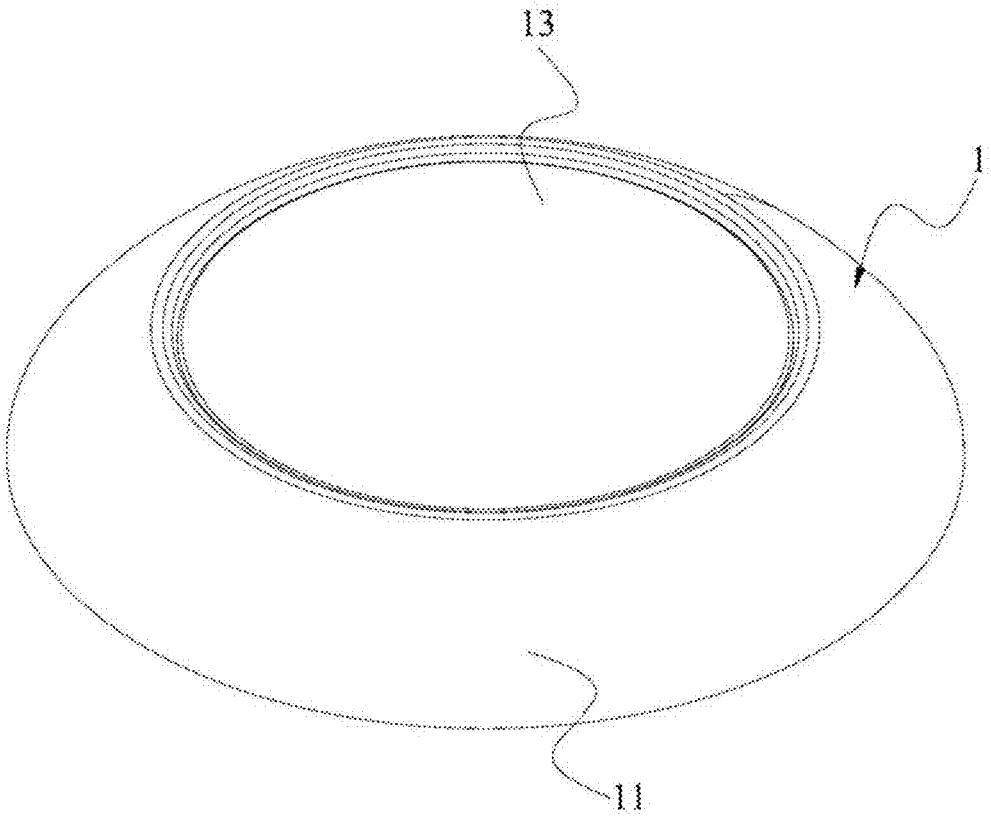
FIG. 1 illustrates a lighting apparatus of an embodiment.
Figure 2:
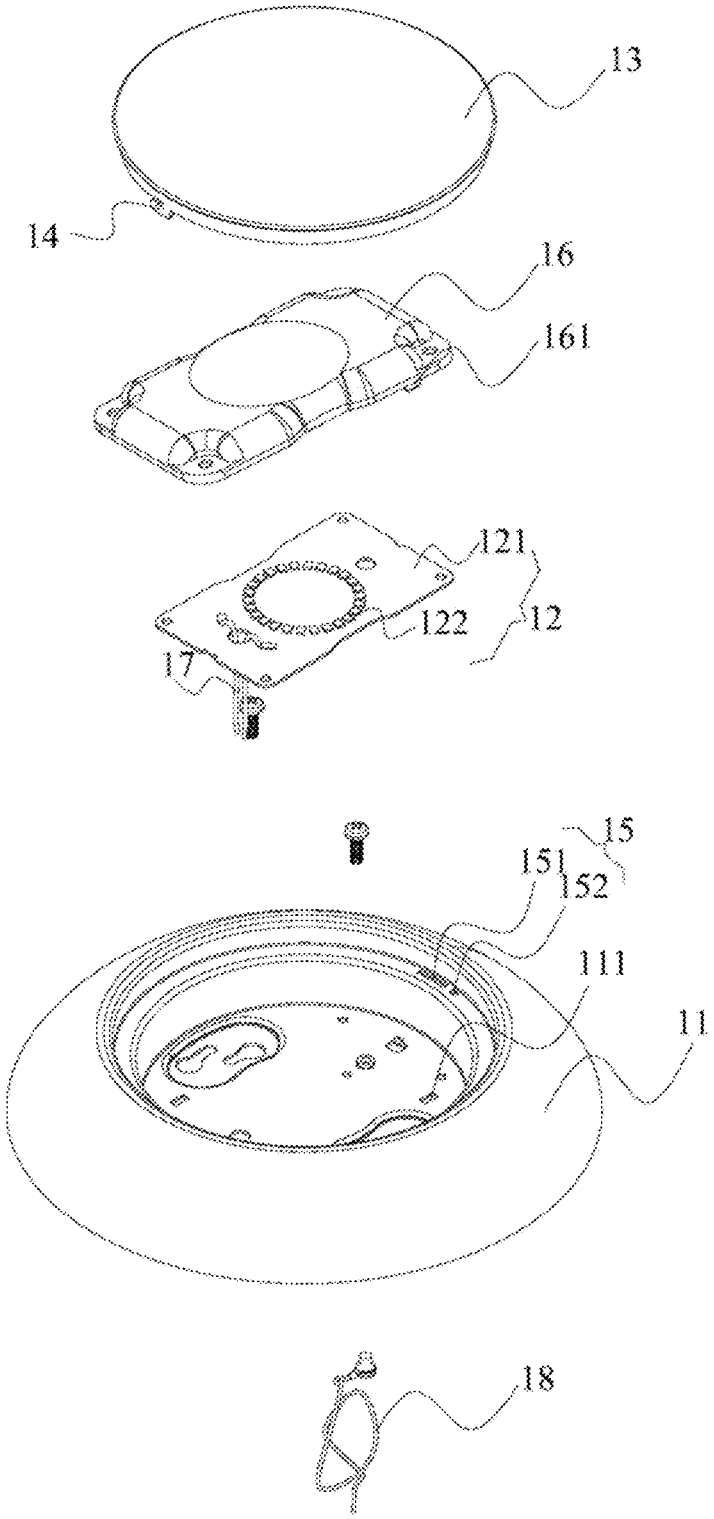
FIG. 2 is an exploded diagram of the embodiment in FIG. 1.

Please refer to FIG. 2. The LED UFO lighting apparatus 1 also has a protection cover 16 covering over the light source module 12. The protection cover 16 is fireproof to prevent the light source module 12 from on fire and to protect the UFO lighting apparatus under dangerous circumstance, such as explosion. The protection cover 16 is capable of being installed on the base housing 11 by screws or other fixing elements. The protection cover 16 is capable of protecting the light source module 12 while being easy to be installed.

In an embodiment, the light source module 12 has a light board 121 and a LED light source 122. The light board 121 connects with the base housing 11, the quantity of the LED light source 122 is multiple. The LED light source 122 distributes evenly on and electrically connects with the light board 121. The portion of the protection cover 16 to the LED light source 122 deviates from the base housing 11 and protrudes. The light emitted by the LED light source 122 goes through the protrusion to avoid the LED light source 122 and to adjust the angle of the light emitted by the LED light source 122 to prevent too-large deflection in the light-emitting direction and to facilitate highly effective emission and even light with no dark zone.

More particularly, in this embodiment, the light board 121 has two connection terminals 17. The light board 121 electrically connects with external power source through two connection terminals 17. One end of the connection terminal 17 passes through the side deviating from the light emitting opening of the base housing 11 to electrically connect with external power source, providing electric current to the LED light source 122.

The light source module 12 also has a driver module being on the light board 121. The driver module electrically connects with the LED light source 122 to drive the LED light source 122. The driver module is set on the light board 121. Namely, the driver module is molded with the LED light source circuit, to be suitable for DOB (Driver on Board) lighting apparatus. The driver module is usually an invisible driver removing AC/DC rectifier and instead molting a LED driver circuit and a LED string circuit. DOB adopts high voltage LED and simplified high voltage driver circuit to be directly driven by indoor power voltage to omit an inductor, an electrolytic capacitor, and a transformer, and further to reduce the volume and cost of the lighting apparatus. For further explanation, to ensure the safety of a LED ceiling light, the LED ceiling light has a ground line 18. The ground line 18 is on the base housing 11.

Figure 8:
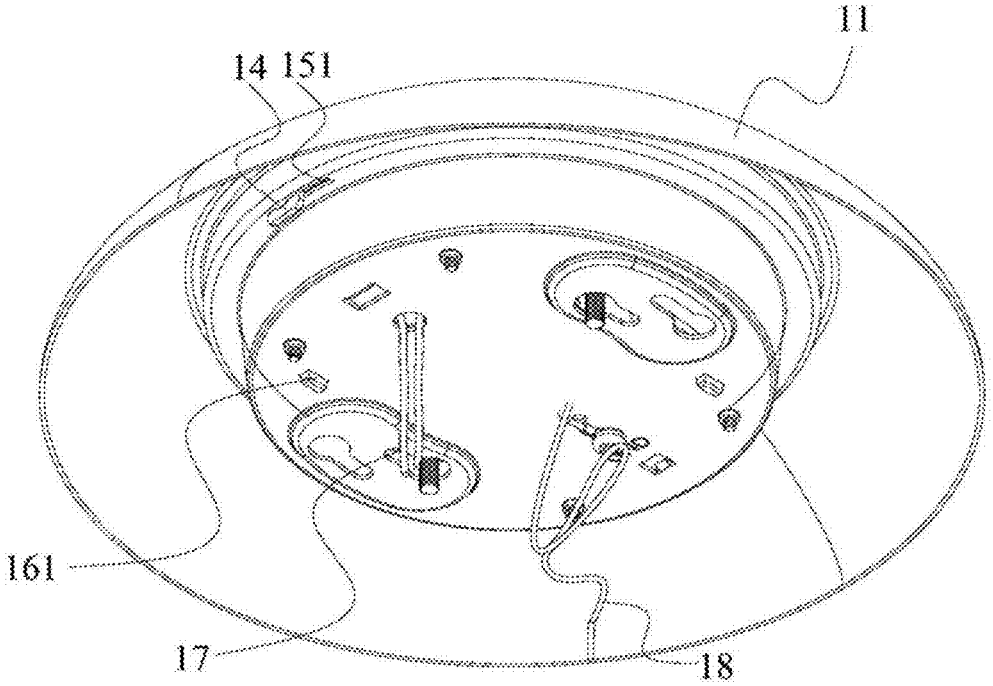
FIG. 8 shows components in an embodiment.

Please refer to FIG. 2 and FIG. 8. To let the protection cover 16 to be accurately installed on the base housing 11, the protection cover 16 extends a positioning protrusion 161 to the base housing 11, and the base housing 11 has a positioning hole 111 connecting with the positioning protrusion 161. With the connection of the positioning protrusion 161 and the positioning hole 111, the protection cover 16 and the base housing 11 are capable of being accurately positioned, and further to ensure the protection cover 16 is capable of being accurately installed on the base housing 11.

More particularly, the concrete installation process of the LED UFO light apparatus 11 is below. Firstly, prepare the base housing 11, and place the light source module 12 into the base housing 11. And then install the positioning protrusion 161 of the protection cover 16 on the positioning hole 111 of the base housing 11. Afterward, use screws or other fixing elements to pass through the protection cover 16 and the light board 121, thus, to install together the protection cover 16 and the light source module 12 on the base housing 11. Finally, align the buckle 14 of the light passing cover 13 with the first buckle groove 151, and rotate the light passing cover 13 to let the protruding portion 1422 to buckle with the second buckle groove 152, and further to finish the installation of the ceiling light.

In an embodiment, a LED ceiling light is provided. The LED ceiling light has a base housing, a light source module and a light passing cover. The base housing has a cup portion and a surface rim portion bending and extending with reversed direction from a opening end of the cup portion to the cup portion. The light source module is on a closed end of the cup portion, the light passing cover covers the opening end, the cup portion and the surface rim portion are integrated one-piece. Place the light source module on the closed end of the cup portion to facilitate the heat dissipation of the cup portion while the surface rim portion beautifies the appearance of the LED ceiling light.

In the embodiment of the LED ceiling light, the cup portion and the surface rim portion of the base housing are integrated one-piece, and the light source module is set in the closed end of the base housing, thus a surface rim, a reflector and a heat sink are set in one body. Simplified structure, effective heat dissipation and reflect light, reduced installation process and cost, and beautiful appearance increase the price-performance ratio of the ceiling light.

In practical application, the cup portion is mainly used for heat dissipation and bearing the light source module. Therefore, the cup portion has aluminum component because aluminum component is easily electric-conductive. To prevent a base body from conducting to cause short circuit, insulating layer is capable of being placed on the surface of the base body or the light source module, or use other insulation measures between the circuit of the light source module and the base body.

In this embodiment, a cross-section of the surface rim portion is a circular ring while a longitudinal section of the surface rim portion is similar to a laddered shape. A lateral side of the laddered shape is oppositely outwardly protruding, the ratio of the perpendicular distance h between the circular ring and the bottom of the surface rim portion and the external diameter of the circular ring r is less than 0.2. More particularly, the "external" of the external diameter refers to the side of the surface rim portion deviating from the cup portion, the external diameter is the semidiameter of the circular ring corresponding to the cross-section of the surface rim portion. More particularly, the surface rim portion has a plurality of cross-section, and the shape of those cross-sections is a circular ring. Namely, the ratio of the perpendicular distance h between the circular ring corresponding to every cross-section and the bottom of the surface rim portion and the external diameter of the circular ring is less than 0.2. Thus, a beautiful curved surface is formed, and further to beautify the appearance of the LED ceiling light.

In an embodiment, to easy processing and shaping, the cup portion and the surface rim portion are integrated one-piece with the same material; namely, the cup portion is aluminum being suitable for heat dissipation, then the surface rim portion is also aluminum to be easy for processing and shaping. More particularly, the surface rim portion and the cup portion is integrated one-piece by mounding. Furthermore, to improve the appearance and protect the cup portion and the surface rim portion, a decoration layer is capable of being set on the surface of the surface rim portion and the cup portion. The decoration layer is capable of being monochrome film, multicolored film, or decorated pattern film.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a cup housing comprising a platform and a first surrounding wall;

a light source module having a plurality of LED modules, the light source being mounted on the platform surrounded by the first surrounding wall;

a protective cover with a second surrounding wall and a top cover, the second surrounding wall and the top cover forming an inner container for covering and protecting the plurality of LED modules of the light source module; and a light passing cover supported by the first surrounding wall, a light of the plurality of LED modules being passed through the light passing cover, wherein the light passing cover has a connector for attaching a detachable optical unit.

2. The lighting apparatus of claim 1, wherein the top cover of the protective cover has a top opening facing to the plurality of LED modules.

3. The lighting apparatus of claim 2, wherein the top opening is attached with an optical lens for changing light directions of the plurality of LED modules.

4. The lighting apparatus of claim 2, wherein the second surrounding wall allows the light of the plurality of LED modules to pass to through, a lateral optical characteristic of the second surrounding wall is different from a top optical characteristic of the top cover.

5. The lighting apparatus of claim 1, wherein the light source module comprises a circuit board mounted with the plurality of LED modules, the second surrounding wall is fixed to the circuit board and forms a module unit together with the light source module.

6. The lighting apparatus of claim 1, wherein there is a metal rim connected to a peripheral edge of the first surrounding wall for enhancing heat dissipation.

7. The lighting apparatus of claim 6, wherein there is an air guiding structure between the first surrounding wall and the metal rim for creating a heat difference environment guiding air to flow for further enhancing heat dissipation.

8. The lighting apparatus of claim 1, wherein the light passing cover comprises a bent portion having a protruding portion, a connecting edge of the first surrounding wall has a first buckle groove and a second buckle groove, when the light passing cover is installed to the first surrounding wall, the bent portion is inserted into the first buckle groove, bent and then hooked in the second buckle groove for fixing the light passing cover to the first surrounding wall.

9. The lighting apparatus of claim 1, wherein there is a temperature sensor structure to turn off a circuit of the light source module.

10. The lighting apparatus of claim 9, wherein the protective cover is made of fireproof material for preventing an accident fire from outside to enter the protective cover.

11. The lighting apparatus of claim 9, wherein the protective cover is made of fireproof material for preventing a circuit covered by the protective cover to be on fire.

12. The lighting apparatus of claim 9, wherein there is deformational structure deformed when a temperature is over a threshold, the deformational structure triggers an alarm procedure.

13. The lighting apparatus of claim 1, further comprising a smoke detector electrically connected to an alarm processor of the light source module.

14. The lighting apparatus of claim 13, wherein when a fire alarm situation is detected, a transmitter sends an alarm message to a neighbor lighting apparatus, the neighbor lighting apparatus relays the alarm message to another processor.

15. The lighting apparatus of claim 13, wherein when a receiver of the light source module receives the alarm message from a neighbor lighting apparatus, the light source module relays the alarm message to another processor.

16. The lighting apparatus of claim 1, wherein the light passing cover is not removable by hand, but the detachable optical unit is detachable by a normal hand for replacing with another optical unit.

17. The lighting apparatus of claim 1, further comprising a central column extended from the platform to the light passing cover.

18. The lighting apparatus of claim 17, wherein a bottom end of the central column has a coil unit for charging an attached device attached on an exterior side of the light passing cover.

19. The lighting apparatus of claim 18, wherein a second light source is attached on a surface of the attached device.

* * * * *